US006478721B1

(12) United States Patent
Hunter

(10) Patent No.: US 6,478,721 B1
(45) Date of Patent: Nov. 12, 2002

(54) ABDOMINAL/LOW/BACK ISOLATION APPARATUS

(76) Inventor: James C. Hunter, 1039 N. Stokes Ave., Santa Maria, CA (US) 93454

( * ) Notice: Subject to any disclaimer, the term of this patent is extended or adjusted under 35 U.S.C. 154(b) by 0 days.

(21) Appl. No.: 09/618,241

(22) Filed: Jul. 18, 2000

Related U.S. Application Data

(60) Provisional application No. 60/097,494, filed on Aug. 21, 1998.

(51) Int. Cl.[7] ..... A63B 26/00; A63B 71/00

(52) U.S. Cl. ..... 482/140; 482/148; 482/72

(58) Field of Search ..... 482/140, 148, 482/121–123, 132, 907, 129, 130, 72, 77, 111–112, 113, 146, 79–83, 9, 142, 901; 272/57

(56) References Cited

U.S. PATENT DOCUMENTS 5,112,045 A * 5/1992 Mason et al. ..... 482/9
5,346,444 A * 9/1994 Hsieh ..... 482/53
5,921,899 A * 7/1999 Rose ..... 482/112
6,024,678 A * 2/2000 Solomon ..... 482/111

FOREIGN PATENT DOCUMENTS

GB 2226769 A * 4/1990

* cited by examiner

*Primary Examiner*—Michael A. Brown
*Assistant Examiner*—Lori Baker Amerson
(74) *Attorney, Agent, or Firm*—Mario A. Martella; James C. Hunter

(57) ABSTRACT

This invention is an abdominal, and low back exercise machine used to tone and strengthen the muscles of the user. The machine includes a frame upon which a slidable foot rest or carriage and a seat are attached. The machine additionally includes a harness coupled to the carriage through a strap such that as the harness moves in a first direction, the carriage moves in the opposite second direction along the frame. The harness is placed around the shoulders and neck of the user such that when the user sits on the seat and brings the shoulders towards the knees, the legs will be drawn up to the shoulders by the movement of the carriage. This exercise device strengthens the user's upper and lower abdominal muscles. The machine further includes an exercise ball which supports the back or stomach while performing hyper-extension type exercises.

24 Claims, 3 Drawing Sheets

ABDOMINAL/LOW/BACK ISOLATION APPARATUS

CROSS-REFERENCE TO RELATED AFPLICATION

The present application claims priority to Provisional Patent Application Serial No. 60/097,494 filed on Aug. 21, 1998.

TECHNICAL FIELD

The present invention generally relates to exercise equipment and particularly to an exercise equipment having an exercise ball or other back support that aides in isolating and strengthening abdominal muscles and the lumbar and spinal erector muscles of the back.

BACKGROUND ART

Proper exercise techniques can strengthen and tone muscles and muscle groups. As such, exercise equipment has been created that can specifically tone and strengthen certain muscles. The exercise equipment is capable of isolating only those muscles that a user wishes to strengthen. Typically, the equipment can aide in the proper positioning of the user, support the user for certain types of exercises, or provide weights and/or resistance in order to aide in strengthening specific muscles.

In order to strengthen lower, middle and upper abdominal muscles, there are two well-accepted kinds of exercises: the sit-up and the crunch. The sit-up is performed by lying on the back with the knees bent and feet flat on the ground. The shoulders are then repeatedly lifted toward the knees with the stomach muscles. This exercise strengthens primarily upper abdominal muscles, but does not specifically tone the lower abdominal muscles.

The crunch is similar to the sit-up and is initiated by lying on the back and then lifting the shoulders toward the knees with the stomach muscles. Simultaneously, the knees are brought up to the shoulders as the shoulders are lifted. This exercise is designed to strengthen the abdominal muscles, Yet is only moderately effective. As the knees are brought up to the shoulders, the hip-flexor muscles in the legs will fire and contract thereby performing most of the work associated in moving the legs upward. Therefore, the lower abdominal muscles are not fully strengthened because the hip-flexor muscles are moving the legs and not the lower abdominal muscles.

Recently in the exercise sciences, the use of an exercise ball has gained popularity. The ball is typically a spherical bladder filled with air and configured to support the weight of the user. The ball is used during exercising by bending the back or stomach over the ball as it rests on the ground. As such, the ball evenly distributes the weight of the user over the curvature of his/her spine or stomach thereby working all muscles more effectively and safely during exercising.

The present invention provides an exercise machine that can strengthen all the abdominal muscles of the user without firing the hip flexors, which is not possible doing conventional crunches or sit-ups. Additionally, the present invention provides an exercise equipment that uses an exercise ball to support the weight of the user, thereby promoting a movement that at all times conforms to and supports the user's spine. The ball also affords the user the ability to initiate the movement from a hyper-flexed position which stretches the abdominal muscles and adds range of motion to the exercise.

A search of prior art patents, exercise catalogs and other health and fitness publications did not disclose any relative prior art.

DISCLOSURE OF THE INVENTION

In accordance with the present invention there is provided an exercise machine that isolates abdominal and lowback muscles. The machine comprises a frame with a carriage slidably attached to the frame and configured to support the user's feet. Furthermore, a transfer arm and a seat are attached to the frame. The seat is adjustable up and down and rotates on an axis which provides a pelvic tilt motion as the user "crunches". The seat is attached to the frame between the carriage and the transfer arm and is configured to support the buttocks of the user. The exercise machine additionally includes a harness configured to be placable over the user's shoulders and attached to an end of an elongate strap. The other end of the strap is attached to the carriage through the transfer arm such that the movement of the harness in a first direction facilitates the concurrent movement of the carriage in a second direction, which is generally opposite the first direction.

The transfer arm comprises a pair of pulleys whereby the strap is extended over and about the pulleys. Additionally, the frame has a pair of rails that the carriage is configured to be slidable upon. In order to support the torso of the user, the exercise machine further includes a deformable, spherically-shaped bladder attached to the frame between the seat and the transfer mechanism. As will be recognized, other forms of back support could be used.

In order to aid in positioning the user, the exercise machine further comprises a pair of handles. The handles are attached to the frame at a location that is graspable by the user's hand while the user's torso is placed stomach down upon the bladder and the user's feet are concurrently placed upon and supported by the carriage which can be locked in a position of choice. This portion is for exercising the lumbar and spinal erector muscles.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 5A shows the foot rest in the substantially horizontal position.

BEST MODE FOR CARRYING OUT THE INVENTION

Figure 3:
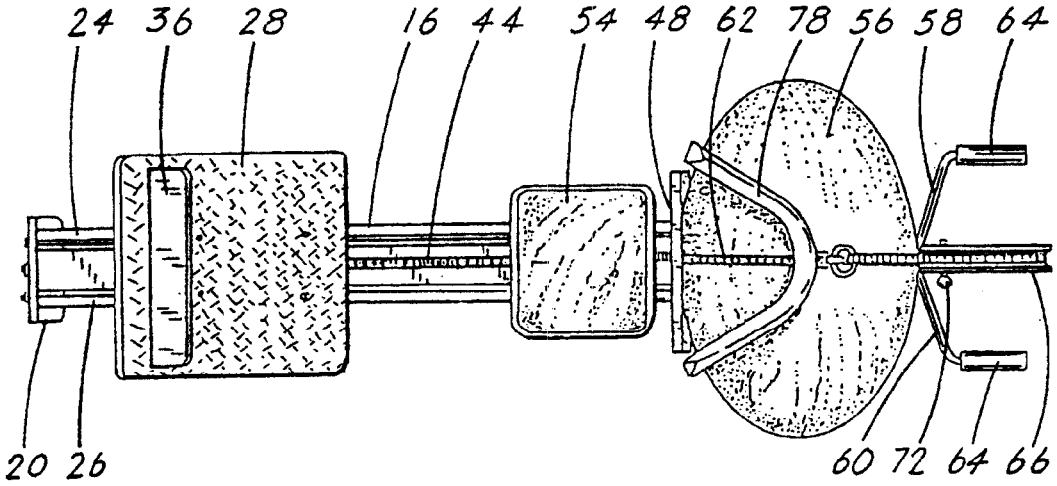
FIG. 3 is a top plan view of the exercise machine shown in FIG. 2.
Figure 4:
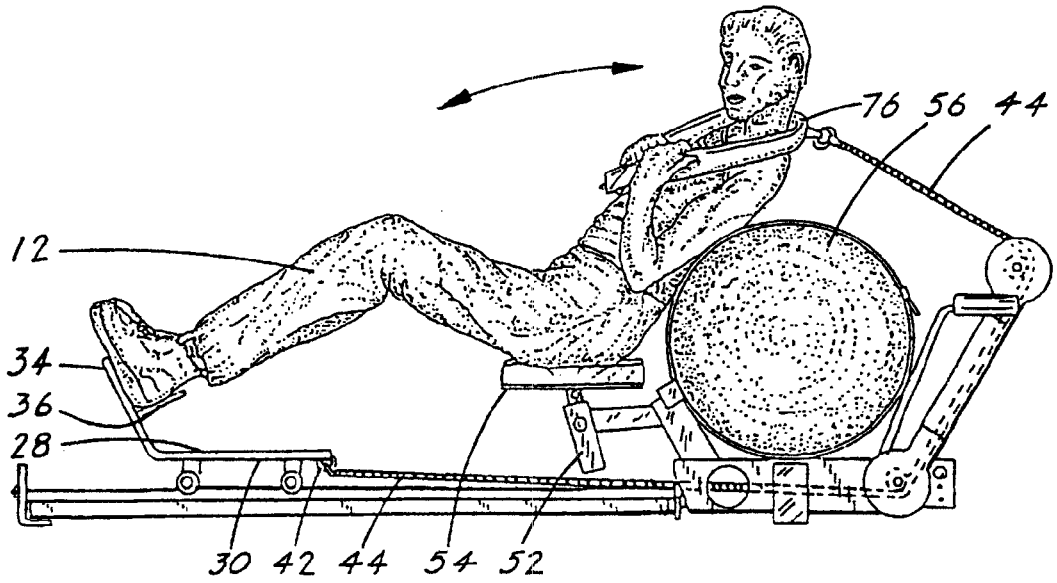
FIG. 4 is a side-elevational view of the present exercise machine as used to strengthen the lower abdominal muscles of the user.
Figure 5A:
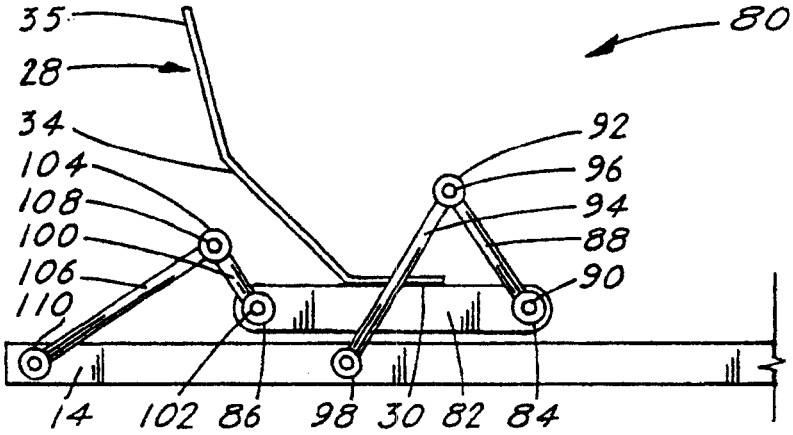
FIG. 5A is a side elevational view of a mechanical linkage that allows the foot rest to be displaced from a substantially horizontal position to an upward angled position.
Figure 5B:
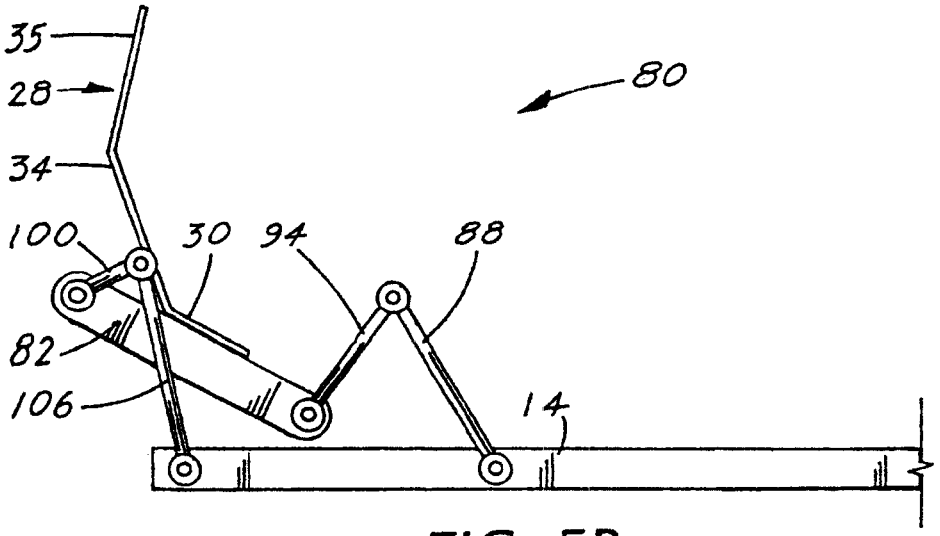
FIG. 5B is a side elevational view showing the foot rest in the upward angled position.
Figure 6:
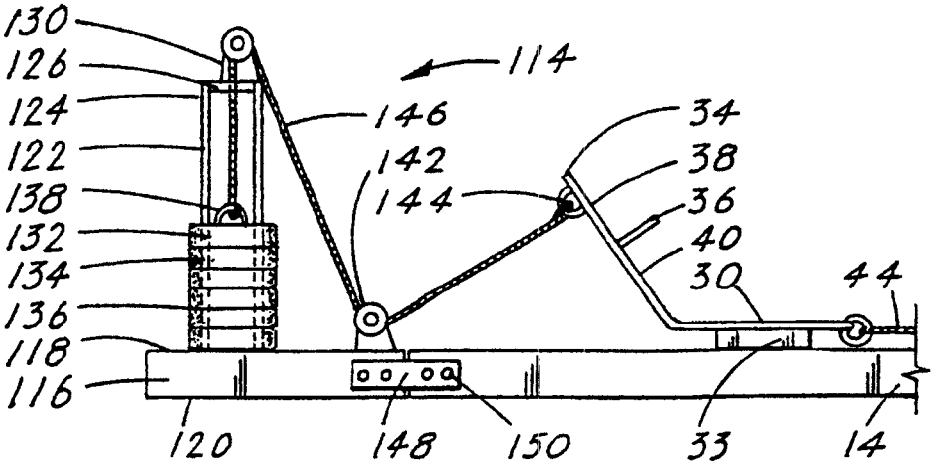
FIG. 6 is a side elevational view showing an adjustable weight stack that is operated by the movement of the foot rest.

The best mode for carrying out the invention is presented in terms of a preferred embodiment as shown in FIGS. 1–4 and two design modifications that can be applied to the preferred embodiment as shown in FIGS. 5A, 5B and 6.

Figure 1:
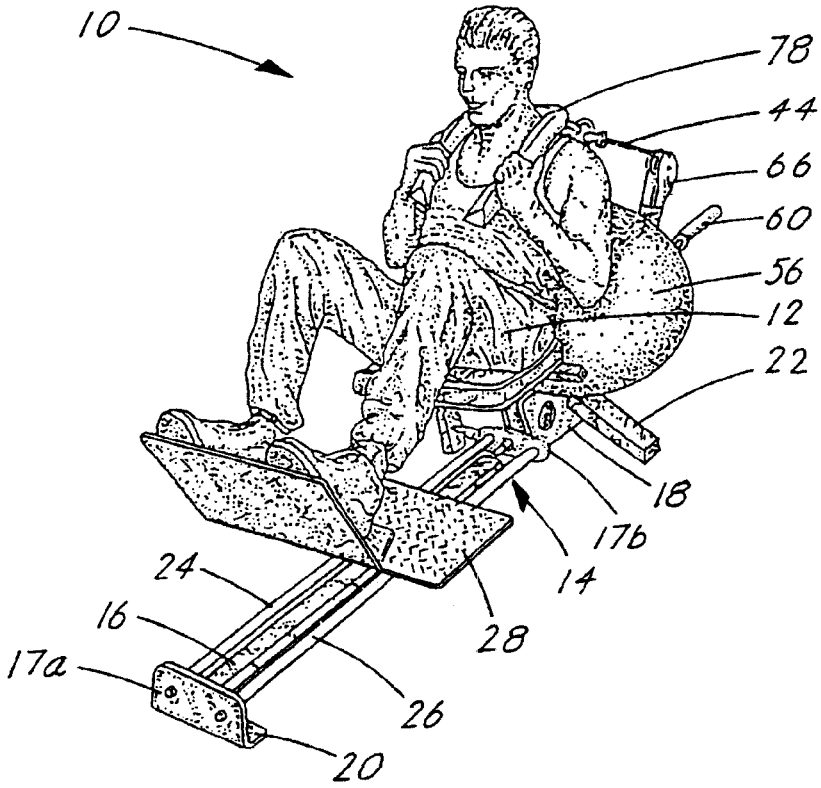
FIG. 1 is a front perspective view of the exercise machine constructed in accordance with the preferred embodiment of the present invention as used to strengthen the lower abdominal muscles of a user.
Figure 2:
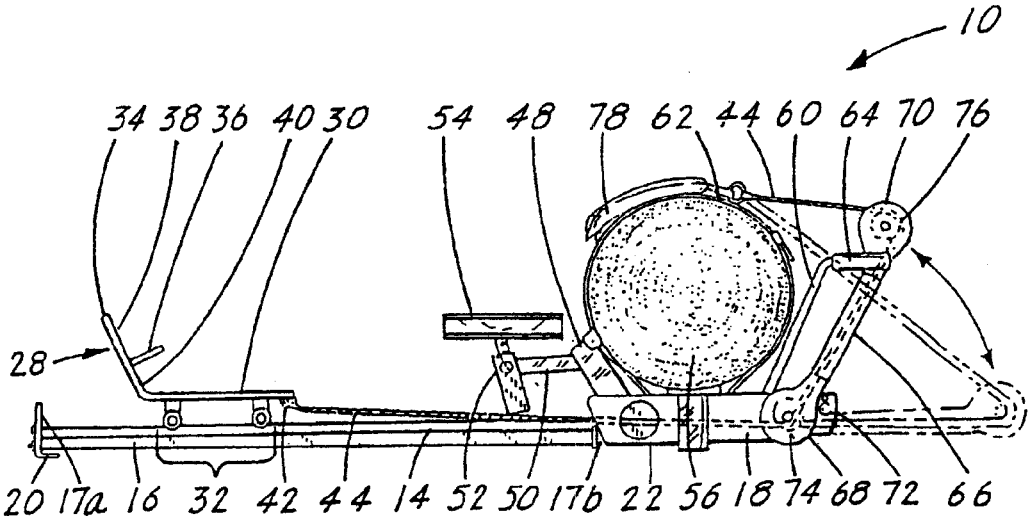
FIG. 2 is a side-elevational view of the exercise machine shown in FIG. 1.

Referring now to FIGS. 1–4 which function to illustrate the preferred embodiment of the present invention only, and not for purposes of limiting the same. FIG. 1 perspectively illustrates an exercise machine 10 used to tone and shape the upper and lower abdominal muscles of a user 12. The machine 10 is designed to strengthen and shape both the upper and lower abdominal muscles of user 12 by preventing the user's hip-flexor muscles from contracting during crunch type exercises such that both the user's upper and lower abdominal muscles are isolated. The exercise machine 10 comprises a frame 14 having a central beam 16 attached to a support member 18. As seen in FIG. 2, the central beam 16 has a generally rectangular cross-sectional configuration and is elongate such that the beam has a first end 17*a* and an opposed second end 17*b*. The second end 7*b* of beam 16 is typically attached to the support member 18 through the use of a welded joint. The frame 14 further comprises a downward-projecting front leg 20 attached to the first end 17*a* of beam 16 and a pair of downward-projecting side legs 22 attached to the sides of support member 18. The front leg 20 and side legs 22 are configured to support the frame 14 during use by user 12.

As shown in FIGS. 2 and 3, a first rail 24 and a second rail 26 are attached to each side of the central beam 16. The rails 24 and 26 are attached at the first end 17*a* and second end 17*b* of beam 16. In this respect, the rails 24 and 26 extend in generally parallel spaced relation along the sides of beam 16.

The exercise machine 10 further comprises a foot rest or carriage 28 that is configured to be slidable on the rails 24,26. The carriage 28 includes a generally planar base portion 30 with two pairs of wheels 32 mounted to a bottom surface thereof. Each pair of wheels 32 is configured to ride on a respective one of the rails 24,26. As will be recognized by those of ordinary skill in the art, each pair of wheels 32 may be replaced by a linear bearing 33, as shown in FIG. 6, to provide a slidable, frictionless engagement between the carriage 28 and the first rail 24 and the second rail 26.

The foot rest or carriage 28 further includes an end wall 34 attached to an edge of the base portion 30 nearest the first end 17*a* of beam 16. The end wall 34 is attached to base portion 30 such that end wall 34 projects upward from base portion 30 at an angle. In this respect, the top surface of base portion 30 transitions into an inner surface of end wall 34. Attached perpendicularly to the inner surface of end wall 34 is a generally planar step 36 that bisects the inner surface of end wall 34 into a top region 38 and a bottom region 40 that can both receive the feet of user 12. As shown in FIGS. 5A and 5B, the foot rest 28 may also be designed to include an inward extending section 35 that integrally extends from the end wall 34 of the foot rest 28. The carriage 28 further includes a connector 42 attached to the bottom surface of base portion 30 for coupling to a strap 44 whose use will be further explained below.

The frame 14 further includes a post 48 attached to the support member 18 near the second end 17*b* of beam 16. The post 48 extends upward from the top of the support member 18 and is slightly angled from a vertical position toward the beam 16. Extending generally horizontal from the top of post 48 is a seat extension 50 attached thereto. Attached to the seat extension 50 is a horizontally telescoping seat adjustment mechanism 52. The adjustment mechanism 52 comprises an inner tube slidably receivable into an outer tube that is attached to the seat extension 50. The inner tube is secured to the outer tube through the use of quick release pin that is aligned with apertures formed within both the inner and outer tubes of adjustment mechanism 52. Attached to the top of the adjustment mechanism 52 is a seat 54 for supporting the buttocks of user 12. As seen in FIG. 2, the seat 54 is positioned above central beam 16 by the post 48, the seat extension 50 and the seat adjustment mechanism 52 such that strap 44 can be led underneath seat 54. The seat 54 is adjustable up and down as well as being able to tilt.

The exercise machine 10 constructed in accordance with the preferred embodiment of the present invention further comprises an exercise ball 56 secured to the frame 14. The exercise ball 56 is a generally spherically-shaped plastic or rubber bladder configured to retain a volume of air and sized to support the torso (i.e., back or stomach) of user 12. The bladder is pressurized with air such that the bladder can be deformable by a slight pressure exerted thereon. In this respect, the bladder is configured to conform to the curvature of the body of user 12. The exercise ball 56 can be sized to match the curvature of the spine of user 12 for maximum support during use. Additionally, the bladder is slightly oblong along an axis perpendicular to a central axis of beam 16, as seen in FIG. 3, in order to laterally support the back of user 12. As will be recognized, other types of supports may be used to support the torso of the user 12.

Referring to FIGS. 2 and 3, the exercise ball 56 is supported on frame 14 by the support member 18, the post 48, a left handle 58, a right handle 60, and a ball support strap 62. Specifically, the exercise ball 56 is placed on the top of support member 16, while post 48 and handles 58,60 support the sides thereof. The ball support strap 62 is attached to support member 18 on both sides of the exercise ball 56 and led over the top of exercise ball 62 such that strap 62 prevents any upward movement of ball 56. As seen in FIG. 2, the post 48, as well as handles 58 and 60 are angled slightly away from a horizontal position. This positioning allows the handles 58,60 and the post 48 to support the sides of the ball 56 as a wedge. Therefore, as strap 62 is tightened downward toward support member 18, the ball 56 is wedged between the handles 58,60 and the post 48.

As seen in FIG. 3, each handle 58,60 is attached to the support member 18 such that each handle 58,60 extends upward from support member 18. On the topmost end of each handle 58,60 is a grip 64 that is graspable by the hands of the user 12 while using the machine. The handles 58,60 are used for positioning the user 12 on the exercise ball 56 during hyper-extension type exercises as will be further explained below.

The exercise machine 10 constructed in accordance with the preferred embodiment of the present invention further includes a transfer arm 66 pivotally coupled to the support member 18 near the handles 58,60. Referring to FIG. 2, the arm 66 comprises a bottom end 68 attached to the support member 18 and a top end 70 positioned at or near the top of the exercise ball 56. The arm 66 is coupled to the support member 18 such that the arm 66 can pivot downward with the removal of a pin 72 as is necessary during hyper-extension exercises. Additionally, the arm 66 comprises a bottom sheave 74 formed near the bottom end 68 and a top sheave 76 formed near the top end 70. The top sheave 76 and the bottom sheave 74 are configured for the strap 44 to be led therethrough. In this respect, each sheave 74,76 may include a roller, pulley or bearing to allow the strap 44 to move easily through each sheave 74,76.

The strap 44 is used during crunch type exercises on machine 10. Referring to FIGS. 1 and 4, a harness 78, that is configured to be placable over the shoulders and neck of user 12, is attached to one end of the strap 44 that exits through top sheave 76. Typically the harness 78 is made from a flexible material and is padded in order for harness 76 to be grasped by the hands of the user 12 while harness 78 is positioned over the shoulders and neck of user 12. The strap 44 is configured to be led through the top sheave 76, through the bottom sheave 74, and then to connector 42 of carriage 28. The strap 44 therefore connects the harness 78 to the carriage 28 through transfer arm 66 such that as harness 78 moves in a first direction, the carriage 28 moves in an opposite second direction along rails 24,26. As will be recognized to those of ordinary skill in the art, the strap 44 may further comprise a buckle or adjustment mechanism to quickly adjust the length of strap 44. As such, the length of strap 44 may be lengthened or shortened according to the height of the user 12 as will be further explained below.

Having described the components of the exercise machine 10, the use of such will now be explained. Specifically, in order to strengthen and tone both the upper and lower abdominal muscles, the user 12 will place his buttocks on seat 54 and his back toward exercise ball 56 as seen in FIGS. 1 and 4. The height of seat 54 is adjusted such that the lower back of user 12 is supported by the exercise ball 56 while the user 12 is leaning back as seen in FIG. 4. The feet of the user 12 are placed above step 36 of carriage 28 such that the feet of user 12 are flat against top region 38 of end wall 34. Next, the user 12 positions the harness 78 over his shoulders and around his neck. The length of strap 44 is adjusted such that the knees of user 12 are slightly bent while harness 78 is around the neck of user 12 and his lower back is supported by exercise ball 56. In order to perform a crunch with the exercise machine 10, the user 12 pushes slightly against carriage 28 and then bend at the waist with the abdominal muscles in order to pull the shoulders toward the knees while holding onto harness 78. Because harness 78 and carriage 28 are attached to each other via strap 44, the movement of the shoulders of user 12 will move the carriage 28 and the legs of user 12 back toward the shoulders of user 12. Since, the user 12 is slightly pushing against the carriage 22, the hip-flexor muscle is not bringing the legs up and therefore is not firing thereby isolating the movement of the upper and lower abdominal muscles. The crunch performed on the exercise machine 10 will only strengthen and tone the isolated upper and lower abdominal muscles of the user 12 and not the hip-flexor muscles. The exercise ball 56 supports the lower back of user 12 by conforming to the shape of the lower back and spreading the exercise load evenly over the spine of the user 12. As will be recognized to those of ordinary skill in the art, if the user 12 performs multiple crunches in sequence with the exercise machine 10, the user 12 will strengthen and tone the upper and lower abdominal muscles exclusively.

The exercise machine 1a constructed in accordance with the preferred embodiment of the present invention can additionally be used to isolate the lower back muscles of the user 12 during hyper-extension type exercises. First the user 12 lowers the transfer arm 66 toward the ground as seen in phantom in FIG. 2. Next the user 12 lowers seat 54 to the bottommost position. Seat 54 and harness 78 are not used during hyper-extension type exercises and therefore are placed into positions that will not interfere with such exercises. The user 12 then places the lower stomach on the exercise ball 56 by supporting the body with handles 58,60 and concurrently position the feet flat against bottom region 40 of carriage 28. Once the user 12 is in position, he or she can perform a hyper-extension exercise by lifting the shoulders backwards using the lower back muscles. The exercise ball 56 evenly supports the load of user 12 thereby providing a secure and stable exercise platform while allowing the user 12 to exercise the lower back muscles exclusively.

As previously stated, two design modifications can be made to the structure of the preferred embodiment to further enhance the utility of the invention.

In the first design modification, as shown in FIGS. 5A and 5B, the foot rest 28 is attached to a mechanical linkage 80 that allows the foot rest 28, when being slid on the rails, to be displaced from a substantially horizontal position, as shown in FIG. 5A, to an upward-angled position, as shown in FIG. 5B. Studies have shown that the resistance drops from the upper abdominal to the lower abdominal when the feet are moved from the horizontal position to the upward-angled position and back to the horizontal position.

The mechanical linkage 80 is comprised of an articulated platform 82 onto which the planar base portion 30 of the foot rest 28 is attached and which includes a first Pivotal joint 84 and a second pivotal joint 86. The mechanical linkage 80 further includes a first link 88 having third and fourth pivotal joints 90,92, wherein the third pivotal joint 90 is attached to the first pivotal joint 84; a second link 94 having a fifth pivotal joint 96 that is attached to the fourth pivotal joint 92 on the first link 88, and a sixth pivotal joint 98 that is attached to the frame 14; a third link 100 having seventh and eighth pivotal joints 102,104, wherein the seventh pivotal joint 102 is attached to the second pivotal joint 86; and a fourth link 106 having a ninth pivotal joint 108 that is attached to the eighth pivotal joint 104 and a tenth pivotal joint 110 that is attached to the frame 14.

In lieu of the mechanical linkage 80 the same function can be performed by attaching an A-frame or the like to the upper surface 118 of the weight stack platform 116. To the upper end of the A-frame is attached a pendulous structure having a lower end attached to the foot rest 28 which is aligned to move from a horizontal position to a substantially vertical position. Alternatively, a concave ramp can be attached to the upper surface 118 of the platform 116. In this design, the foot rest 28 traverses the upper surface of the ramp by means of rollers or at least one captive rail.

In the second design modification an adjustable weight assembly 114 that is operated by the movement of the foot rest 28 is disclosed. The assembly 114, as shown in FIG. 6, increases the resistance applied to an exercise routine and is comprised of five major elements: a weight-stack platform 116, a first pulley assembly 130, at least one weight 132, a first cable attachment loop 138, a second pulley assembly 142, a second cable attachment loop 144, and a cable 146.

The weight-stack platform 116 has an upper surface 118 and a lower surface 120. To the upper surface is attached a pair of weight rods 122 each having an upper end 124 to which is rigidly attached a cross member 126. To the cross member 126 is then attached the first pulley assembly 130.

The weights 132 each have a pair of weight rod bores 134 that when inserted into the respective weight rods 122 the weights are captively held thereto. In lieu of a pair of rod bores 134 a single rod bore can be utilized to captively hold the at least one weight or preferably a plurality of weights. In either case, the weights 132 are designed with a means 136 for being interlocked to each other to form a weight stack selected for a Particular weight applicable to the exercise routine being performed. The uppermost weight 132, as shown in FIG. 6, has attached thereto the first cable attachment loop 138.

The second Pulley assembly 142 is located inward from the weight stack and is attached to the upper surface 118 of the weight-stack platform 116. The second cable attachment loop 144 is attached to the end wall 34 of the foot rest 28.

The final element of the adjustable weight-stack assembly 114 is the cable 146. The cable, as also shown in FIG. 6, is connected sequentially commencing from the first cable attachment loop 138, through the first pulley assembly 130, the second pulley assembly 142, and terminates at the second cable assembly loop 144. The assembly 114 is designed to be operated by a user 12 when the user causes the foot rest 28 to move forward or rearward.

The assembly 114 can be designed to include the weight stack platform 116 as an integral extension of the frame 80, or the assembly 114 can be a separate assembly and have the weight-stack platform 116 attached to the frame 14 by a pair of side plates 148 as shown in FIG. 6. The plates can be attached by a plate attachment means 150 which includes bolts or a welding process.

As will be recognized by those of ordinary skill in the art, other types of exercises may be performed on the exercise machine 10. The combination of the carriage 28, seat 54, handles 58,60 and exercise ball 56 allow for the body of user 12 to be placed in many different positions. Therefore, the exercise machine 10 can be used to strengthen and tone many different muscles of user 12, not just the lower back and upper and lower abdominal muscles.

Additional modifications and improvements of the present invention may also be apparent to those of ordinary skill in the art such as providing resistance against the carriage 28 in the form of weights, a spring or an air cylinder further strengthens and tones muscle groups. Thus, the particular combination of parts described and illustrated herein is intended to represent only a certain embodiment of the present invention, and is not intended to serve as a limitation of alternative devices within the spirit and scope of the invention.

What is claimed is:

1. An exercise machine for a user comprising:

a) a frame, b) a carriage slidably attached to the frame and configured to support the user's feet, c) a transfer arm attached to the frame, d) a seat attached to the frame between the transfer arm and the carriage, e) a harness configured to be placed over the user's shoulders, and f) an elongate strap having opposed ends attached to respective ones of the carriage and the harness, the strap being cooperatively engaged to the transfer arm such that the movement of the harness in a first direction facilitates the concurrent movement of the carriage in a second direction which is generally opposite the first direction, (g) a deformable bladder attached to the frame, and a foot rest attached to the frame in spaced relation to the bladder, the exercise machine being configured such that the user's torso may be placed upon and supported by the bladder concurrently with the user's feet placed upon and supported by the foot rest.

2. The exercise machine of claim 1 wherein the bladder is filled with a volume of air.

3. The exercise machine of claim 1 wherein the bladder is spherically shaped.

4. The exercise machine of claim 2 further comprising a seat which is attached to the frame for supporting the user's buttocks when the user's torso is placed upon and supported by the bladder and the user's feet are placed upon and supported by the foot rest.

5. The exercise machine of claim 2 wherein the foot rest is slidably attached to the frame.

6. The exercise machine of claim 2 further comprising at least one handle attached to the frame at a location wherein the handle is graspable by the user's hands when the user's torso is placed upon and supported by the bladder and the user's feet are placed upon and supported by the foot rest.

7. The exercise machine of claim 1 wherein the transfer arm comprises a pair of pulleys, the strap being extended over and about the pulleys.

8. The exercise machine of claim 1 wherein the frame has a pair of rails, the carriage being configured to be slidable upon the rails.

9. The exercise machine of claim 1 further comprising a deformable bladder attached to the frame between the seat and the transfer mechanism, the bladder being sized and configured to support the user's torso.

10. The exercise machine of claim 9 wherein the bladder is filled with a volume of air.

11. The exercise machine of claim 9 wherein the bladder is spherically shaped.

12. The exercise machine of claim 9 further comprising at least one handle attached to the frame at a location wherein the handle is graspable by the user's hands when the users torso is placed upon and supported by the bladder and the user's feet are placed upon and supported by the carriage.

13. The exercise machine of claim 12 comprising a pair of handles attached to the frame.

14. A method to exercise a user's lower abdominal muscles on an exercise machine having a slidable carriage configured to support the user's feet, a seat configured to support the user's buttocks, and a harness attached to the carriage such that as the harness moves in a first direction the carriage moves in a second direction generally opposite the first direction, the method comprising the steps of:

a) positioning the user's buttocks on the seat, b) placing the user's feet on the carriage, c) placing the harness over the user's neck and shoulders, d) applying constant pressure against the carriage with the user's feet to place the user in a starting position, e) moving the user's shoulders toward the user's feet with the user's abdominal muscles such that the user's feet are drawn toward the user's shoulders by the carriage connected to the harness, and f) returning the user's shoulders to the starting position.

15. The method of claim 14 wherein steps (e) and (f) are consecutively repeated to perform multiple exercises.

16. The method of claim 14 wherein the exercise machine further comprises a deformable exercise ball disposed adjacent to the seat and configured to support the user's lower back, and step (c) further comprises: placing the user's lower back against the exercise ball.

17. A method of exercising a user's lower back muscles on an exercise machine having a foot rest configured to support the user's feet, a deformable exercise ball configured to support the user's abdomen and at least one handle configured to be graspable by the user's hands when the user's abdomen is supported by the exercise ball, the method comprising the steps of:

a) positioning the user's feet on the foot rest, b) placing the user's abdomen on the exercise ball to place the user's shoulders in a starting position, c) grasping the handle with the user's hands, d) moving the user's shoulders away from the exercise ball, and e) returning the user's shoulders to the starting position.

18. The method of claim 17 wherein steps d) and e) are consecutively repeated to perform multiples exercises.

19. The exercise machine of claim 6 wherein the foot rest further comprises an inward-extending section that extends from the end wall.

20. The exercise machine of claim 19 wherein the foot rest is attached to a mechanical linkage that allows the foot rest, when being slid on the rails, to be displaced from a substantially horizontal position to an upward angled position.

21. The exercise machine of claim 20 wherein the mechanical linkage comprises:

a) an articulate platform onto which the planar base portion of the foot rest is attached, the platform having a first pivotal joint and a second pivotal joint, b) a first link having a third pivotal joint and a fourth pivotal joint, wherein the third pivoted joint is attached to the first pivotal joint, c) a second link having a fifth pivotal joint attached to the fourth pivotal joint on the first link and a sixth pivotal joint attached to the frame, d) a third link having a seventh pivotal joint and an eighth pivotal joint, wherein the seventh pivotal joint is attached to the second pivotal joint, and e) a fourth link having a ninth pivotal joint attached to the eighth pivotal joint and a tenth pivotal joint attached to the frame.

22. The exercise machine of claim 6 further comprising an adjustable weight stack assembly operated by the movement of the foot rest.

23. The exercise machine of claim 22 wherein the adjustable weight stack assembly comprises:

a) a weight-stack platform having an upper surface and a lower surface, wherein to the upper surface is attached a pair of weight rods each having an upper end to which is attached a first pulley assembly, b) at least one weight having there through a pair of rod bores that when inserted into the weight rods, the weights are captively held thereto, wherein the weights have a means for being interlocked to each other with the uppermost weight having attached thereto a first cable attachment loop, c) a second pulley assembly located inward from the weights and attached to the upper surface of the weight-stack platform, d) a second cable attachment loop attached to the and wall of the foot rest, and a cable connected sequentially from the first cable attachment loop, through the first pulley assembly, the second pulley assembly and to the second cable attachment loop, wherein when the user causes the foot rest to move forward or rearward the weights increase the resistance of the exercise routine being performed.

24. The exercise machine of claim 22 wherein the weight stock assembly further comprises a first and second side plates that are attached by an attachment means between the interface of the frame and weight-stack platform.

* * * * *